US010366857B2

(12) United States Patent
Yang et al.

(10) Patent No.: US 10,366,857 B2
(45) Date of Patent: Jul. 30, 2019

(54) MAGNETRON FOR MICROWAVE OVEN

(71) Applicant: LG ELECTRONICS INC., Seoul (KR)

(72) Inventors: Haksoon Yang, Seoul (KR); Sunghun Sim, Seoul (KR); Heungsik Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/703,002

(22) Filed: Sep. 13, 2017

(65) Prior Publication Data

US 2018/0114668 A1 Apr. 26, 2018

(30) Foreign Application Priority Data

Oct. 24, 2016 (KR) ..... 10-2016-0138429

(51) Int. Cl.

| | |
|---|---|
| ***H01J 23/11*** | (2006.01) |
| ***H01J 25/50*** | (2006.01) |
| ***H01J 23/15*** | (2006.01) |
| ***H05B 6/76*** | (2006.01) |

(52) U.S. Cl.

CPC ..... *H01J 23/11* (2013.01); *H01J 23/15* (2013.01); *H01J 25/50* (2013.01); *H05B 6/76* (2013.01)

(58) Field of Classification Search

CPC .. H01J 23/00; H01J 23/11; H01J 23/14; H01J 23/15; H01J 25/00; H01J 25/50; H01J 25/587; H05B 6/64; H05B 6/76

See application file for complete search history.

(56) References Cited

U.S. PATENT DOCUMENTS 4,705,989 A * 11/1987 Takada ..... H01J 23/15 313/341
5,021,713 A * 6/1991 Uesawa ..... H01J 23/15 315/39.51
5,294,864 A * 3/1994 Do ..... H01J 25/587 315/39.51
5,406,167 A * 4/1995 Choi ..... H01J 23/15 313/242
5,508,583 A 4/1996 Lee (Continued)

FOREIGN PATENT DOCUMENTS

CN 102243971 11/2011
EP 1 517 351 3/2005

(Continued)

OTHER PUBLICATIONS

Korean Office Action dated Jan. 15, 2018.
European Search Report dated Apr. 4, 2018.

*Primary Examiner* — Thai Pham
(74) *Attorney, Agent, or Firm* — Ked & Associates, LLP

(57) ABSTRACT

A magnetron for a microwave oven is provided that decreases noise in an ISM band by minimizing a size of a lower end shield, and thus, minimizing EMI generation. In the magnetron for the microwave oven, as a midpoint of a side lead hole is positioned inside a virtual circle formed by points positioned at a predetermined distance from a midpoint of the shield disc and a side lead is connected in a straight line, there are advantages that a further bending process is not generated and a defective rate that occurs in the manufacturing process of the shield disc may be decreased.

20 Claims, 14 Drawing Sheets

(56) References Cited

U.S. PATENT DOCUMENTS

| | | | | | |
|---|---|---|---|---|---|
| 5,621,269 | A * | 4/1997 | Jang | H01J 23/05 | 174/151 |
| 5,686,007 | A * | 11/1997 | Jang | H01J 23/15 | 219/738 |
| 6,089,634 | A * | 7/2000 | Verhey | B66C 1/66 | 294/82.35 |
| 2004/0060933 | A1 * | 4/2004 | Han | H01J 23/15 | 219/756 |
| 2005/0062427 | A1 * | 3/2005 | Saitou | H01J 23/05 | 315/39.51 |

FOREIGN PATENT DOCUMENTS

| | | |
|---|---|---|
| JP | 05-35531 | 5/1993 |
| JP | H0673275 | 9/1994 |
| JP | 2009-205949 | 9/2009 |
| KR | 10-1999-015690 | 3/1999 |
| KR | 10-2002-0037078 | 5/2002 |
| KR | 10-2003-0089303 | 11/2003 |
| KR | 10-0631734 | 9/2006 |

* cited by examiner

FIG. 10

| | Item | Cap | Po (W) | fO (MHz) | η (%) |
|---|---|---|---|---|---|
| LOWER END SHIELD SIZE DECREASE | MG #1 | 14.0 | 1074.0 | 2465 | 74.8 |
| | MG #2 | 14.0 | 1051.0 | 2464 | 74.1 |
| | MG #3 | 14.0 | 1039.0 | 2461 | 72.4 |
| | MG #4 | 14.0 | 1039.0 | 2463 | 73.0 |
| | MG #5 | 14.0 | 1093.5 | 2469 | 75.0 |
| | MG #6 | 14.0 | 1115.0 | 2467 | 77.0 |
| | MG #7 | 14.0 | 1063.5 | 2469 | 73.1 |
| | MG #8 | 14.0 | 1071.6 | 2470 | 74.7 |
| | MG #9 | 14.0 | 1054.3 | 2468 | 74.0 |
| | MG #10 | 14.0 | 1105.0 | 2469 | 76.3 |
| | avg. | | 1070.6 | 2467 | 74.4 |
| MGT OF RELATED ART | G1 #1 | 14.0 | 1010 | 2463 | 70.4 |
| | G1 #2 | 14.0 | 1010 | 2466 | 70.5 |
| | G1 #3 | 14.0 | 1037 | 2465 | 71.4 |
| | G1 #4 | 14.0 | 1010 | 2466 | 71.2 |
| | G1 #5 | 14.0 | 999 | 2465 | 69.9 |
| | avg. | | 1013 | 2465 | 70.7 |

MAGNETRON FOR MICROWAVE OVEN

CROSS-REFERENCE TO RELATED APPLICATION(S)

The present application claims priority under 35 U.S.C. § 119 and 35 U.S.C. § 365 to Korean Patent Application No. 10-2016-0138429 filed in Korea on Oct. 24, 2016, all of which are hereby incorporated by reference in their entirety.

BACKGROUND

1. Field

A magnetron for a microwave oven is disclosed herein.

2. Background

Generally, the magnetron is a device which is mounted in a microwave oven, or an illumination device, for example, and converts electric energy into high-frequency energy, such as microwaves. The magnetron can be divided into an anode, a cathode, or a magnetic portion, for example, in terms of operation.

A structure of the magnetron is disclosed in Korean Patent Laid-Open Publication No. 10-2002-0037078, published on May 18, 2002 and hereby incorporated by reference, which is the related art. In an operation of the related art magnetron for a microwave oven, a magnetic field formed by the permanent magnets forms a magnetic circuit along an upper magnetic pole and a lower magnetic pole, so that a magnetic field is generated in a working space between a vane and a filament. The filament emits thermal electrons at a temperature of about 2000K while an external power is applied to the filament. In the working space, an electron group is formed by the emitted thermal electron. The electron group is rotated within the working space by an anode voltage of 4.0 to 4.4 kV and a magnetic field which is applied between the filament and the anode portion.

More specifically, a strong electric field is formed in the working space by the anode voltage applied to the anode and the magnetic field acts in a vertical direction of the electric field. By the electric field and the magnetic field, the electron group proceeds to the vane while performing a cycloid movement in the working space and a high frequency having a resonance frequency corresponding to the speed at which the electron group rotates is induced to the vane. In other words, the magnetron generates microwaves of 2.45 GHz by being applied a high-voltage power to radiate the microwaves to a cooking chamber of the microwave oven, and the microwave cooks food in the cooking chamber.

The frequency band of 2.4 to 2.5 GHz is an industrial scientific medical (ISM) band, which is a band that industrial, scientific, and medical devices can use without authorization or restrictions. Not only microwave ovens but also household appliances, such as Bluetooth, WI-FI, and a television use the ISM band.

As many electronic devices can use the ISM band without limitation, unnecessary noise generated in any electronic device may cause a malfunction in the operation of other electronic devices. In other words, electromagnetic interference (EMI) may be generated. Therefore, in order to prevent the electromagnetic interference, the noise generated during the operation of the electronic device must be decreased.

On the other hand, the magnetron for the microwave oven generates not only electromagnetic waves in the ISM band, but also electromagnetic waves in a frequency band other than the ISM band. A prevention standard of the electromagnetic interference (EMI) is 92 dB μV/m (hereinafter, the unit thereof is simply referred to as "dB") in the frequency range of 2.5 GHz to 5.725 GHz, and in a case where the microwave oven product has a peak value which is less than 88 dB (a value of 92 dB-4 dB) in the corresponding frequency range, it can be determined that the prevention standard described above is met. In the case of the related art magnetron for a microwave oven, the peak value in the frequency range of 2.5 GHz to 2.6 GHz has a value level slightly lower than 92 dB, and thus, there is a problem of exceeding the standard in a case in which an unexpected problem is generated during operation of the microwave oven.

BRIEF DESCRIPTION OF THE DRAWINGS

Embodiments will be described in detail with reference to the following drawings in which like reference numerals refer to like elements, and wherein:

FIG. 10 is a graph illustrating an experimental result table illustrating a state where output and efficiency of the magnetron according to embodiments are improved, compared with the related art;

DETAILED DESCRIPTION

Figure 1:
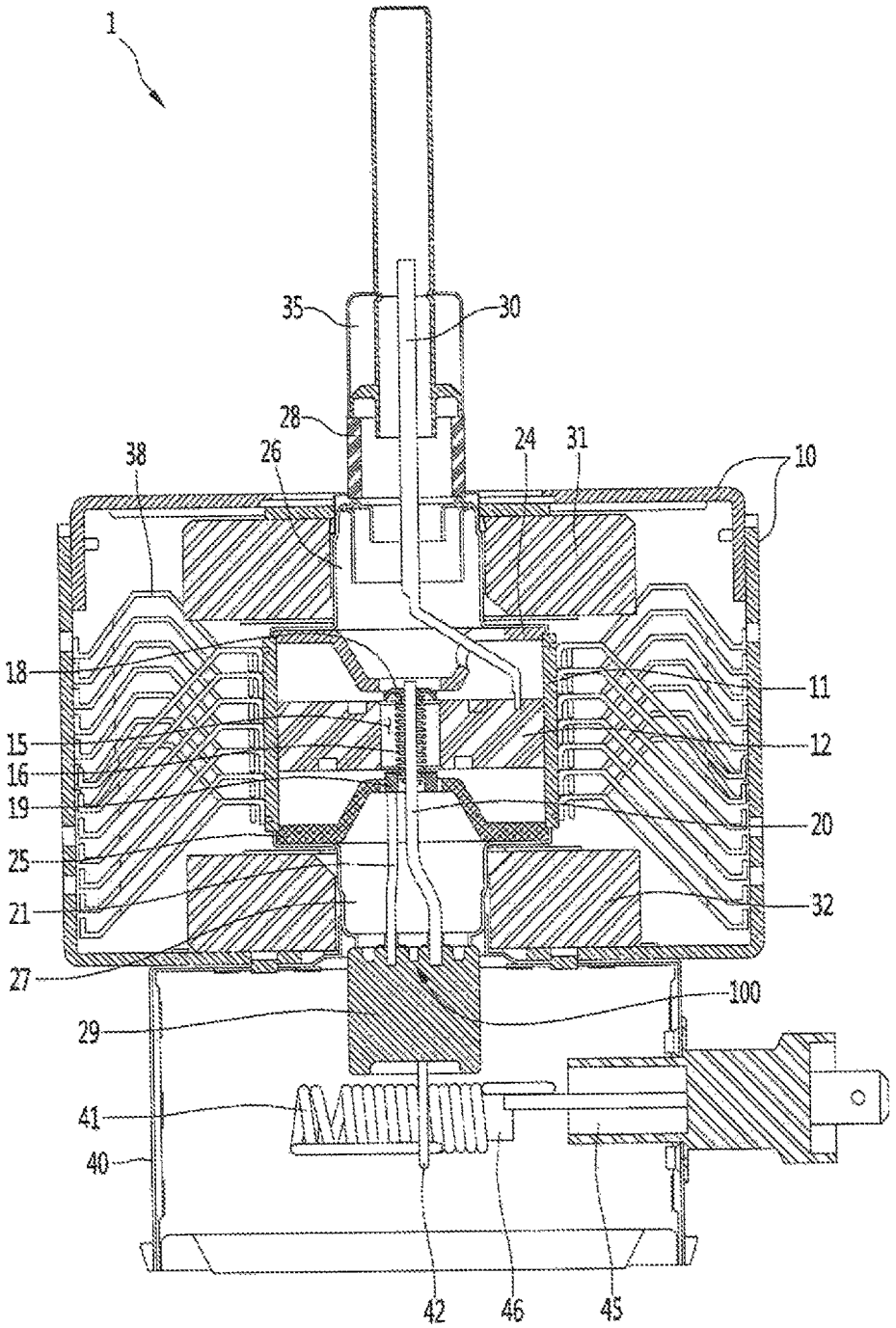
FIG. 1 is a cross-sectional view of a magnetron according to an embodiment.

Exemplary embodiments will be described below with reference to the accompanying drawings. It is also noted that like reference numerals denote like elements in appreciating the drawings even though the same elements are displayed on other drawings. Moreover, detailed descriptions related to well-known functions or configurations will be ruled out in order not to unnecessarily obscure subject matters of the present disclosure.

Also, in descriptions of the elements, terms "a first", "a second", etc and reference symbols "A", "B", "(a)", "(b)", etc may be used. These terms and reference symbols are used only to differentiate one element from the other element. Thus, the order of the elements corresponding to the terms and reference symbols given in the description is not limited thereto. In the following description, it will be understood that when an element is referred to as being "connected", "coupled", or "contact" another element, it can be directly connected or contact, or intervening elements may be also be "connected", "coupled" or "contact" between the elements.

FIG. 1 is a cross-sectional view of a magnetron according to an embodiment. With reference to FIG. 1, a magnetron 1 for a microwave oven according to an embodiment may include a yoke 10 which constitutes a body, an anode cylinder 11 which is installed or provided inside the yoke 10 in a cylindrical shape, and a plurality of vanes 12 which form a cavity resonator to induce a high frequency component at an inside portion of the anode cylinder 11.

The plurality of vanes 12 may be disposed at equal intervals at a center of the anode cylinder 11 in a vertical or axial direction. In other words, the plurality of vanes 12 may be disposed radially toward an axial center. An inner uniform pressure ring and an outer uniform pressure ring may be coupled to be alternately connected to an upper portion and a lower portion thereof in or at a tip portion side of the plurality of vane 12. The anode cylinder 11 and the plurality of vanes 12 may be referred to as "anodes".

In addition, the magnetron 1 for a microwave oven according to an embodiment may include a filament 16, an upper end shield 18, a lower end shield 19, a center lead 20, a side lead 21, a upper magnetic pole 24, a lower magnetic pole 25, an A-chamber 26, an F-chamber 27, an A-ceramic 28, an F-ceramic 29, an upper magnet 31, and a lower magnet 32. The filament 16 may be spirally formed on a central axis of the anodes. More specifically, the filament 16 may be positioned on a central axis of the anode cylinder 11 and can be wound in a spiral manner.

The filament 16 may be made of thorium tungsten, for example, and may emit electrons exceeding a work function. In other words, the filament 16 may be heated by a supplied current to emit thermal electron.

A working space 15 may be formed as an empty space between the filament 16 and the end of the vane 12. The working space 15 guides a cycloid movement of electrons by electric and magnetic field forces.

The upper end shield 18 and the lower end shield 19 may prevent electrons emitted from the filament 16 from deviating in the axial direction. The upper end shield 18 may be disposed or provided on or at an upper end of the filament 16 and the lower end shield 19 may be disposed or provided on or at a lower end of the filament 16.

The center lead 20 may be disposed or provided so as to be inserted into a through hole formed in a central portion of the lower end shield 19 and be fixed to a lower surface of the upper end shield 18. More specifically, the center lead 20 may be installed or provided at the center of the filament 16, an upper end thereof may be coupled to the upper end shield 18, and the lower end thereof may extend downward through the lower end shield 19. The center lead 20 may be made of molybdenum, for example.

The side lead 21 may be installed or provided on a lower surface of the lower end shield 19 at a predetermined distance from the center lead 20. An upper end portion of the side lead 21 may be joined with and fixed to the lower surface of the lower end shield 19. In other words, the side lead 21 may be coupled to a periphery of the lower end shield 19.

An upper end of the side lead 21 may be connected to the lower end shield 19 and the lower end thereof may be connected to a shield disc 100. The side lead 21 may be spaced apart from the center lead 20 in a space between the lower end shield 19 and the shield disc 100. In addition, the side lead 21 may be made of molybdenum, for example.

The center lead 20 and the side lead 21 may be connected to an external power source so as to apply power to the filament 16. The center lead 20 and the side lead 21 may guide so that the power is applied to the filament 16. When power is applied to the center lead 20 and the side lead 21, the filament 16 may emit thermal electron toward the plurality of vanes 12.

The lower portions of the center lead 20 and the side lead 21 may be surrounded by an insulator and fixed thereto. Details thereof will be described hereinafter.

The filament 16, the upper end shield 18, the lower end shield 19, the center lead 20, and the side lead 21 may be referred to as a "cathode". The upper magnetic pole 24 may be coupled to an upper opening portion or opening of the anode cylinder 11 in the form of a funnel made of a magnetic material. The lower magnetic pole 25 may be coupled to a lower opening portion of the anode cylinder 11 in the form of a funnel shape made of a magnetic material.

The A-chamber 26 may be joined to an upper side of the upper magnetic pole 24 by, for example, brazing. The A-ceramic 28 may be joined to an upper side of the A-chamber 26 by, for example, brazing and may output high frequency to the outside. An exhaust pipe may be joined to the upper side of the A-ceramic 28 by, for example, brazing and an upper end portion or end of the exhaust pipe may be joined at a same time as cutting to seal an inner portion of the anode cylinder 11 in a vacuum state.

An antenna 30 that outputs a high frequency oscillated in a cavity resonator may be provided inside of the A-chamber 26. A lower end portion or end of the antenna 30 may be connected to only one of the plurality of vanes 12 and an upper end portion or end thereof may be fixed to an inner upper surface of the exhaust pipe.

The F-seal 27 may be joined to a lower side of the lower magnetic pole 25 by, for example, brazing. The F-ceramic 29 may be joined to a lower side of the F-seal 27 by, for example, brazing and may be insulated.

The upper magnet 31 and the lower magnet 32 may be coupled to an upper side and a lower side of the anode cylinder 11 so as to be in contact with the inner surface of the yoke 10. The upper magnetic pole 24, the lower magnetic pole 25, the upper magnet 31, and the lower magnet 32 may form a magnetic field circuit. In addition, the magnetron 1 for a microwave oven according to an embodiment may further include a filter box 40, a choke coil 41, an F-lead 42, shield disc 100, a capacitor 45, a ferrite 46, a cooling fin 38, and an antenna cap 35.

The filter box 40 may be coupled to the lower side of the yoke 10 as a box body. A pair of choke coils 41 may be installed or provided inside of the filter box 40 to attenuate harmonic noise flowing back to an input unit or input.

One end portion or end of each choke coil 41 may be electrically connected to a lower end portion or end of a pair of F-leads 42 which may be inserted into a through-hole formed in the F-ceramic 29. An upper end portion or end of the pair of F-leads 42 inserted into and coupled to the through hole of the F-ceramic 29 may be connected to lower surfaces of the pair of shield discs 100 provided on an upper side of the F-ceramic 29, respectively. The F-lead connected to a center lead disc 110, which will be described hereinafter, which is one of the pair of F-leads 42, may be referred to as a "first F-lead" and the F-leads connected to a side lead disc 120, which will be described hereinafter, which is the other one of the pair of F-leads 42, may be referred to as a "second F-lead".

Lower ends of the center lead 20 and the side lead 21 may be joined to an upper surface of the shield disc 100, respectively. In summary, the upper surfaces of the pair of shield discs 100 may be connected to the center lead 20 and the side lead 21 and the lower surface of the pair of shield discs 100 may be connected to the pair of F-lead. Therefore, the center lead 20, the first F-lead 42, the side lead 21, and the second F-lead 42 may be electrically connected through the pair of shield discs 100. The pair of shield discs 100 will be described hereinafter.

The capacitor 45 may be installed or provided on a side wall of the filter box 40. An inner end of the capacitor 45 may be electrically connected to the choke coil 41 and a ferrite 46 that absorbs low frequency noise may be inserted into the choke coil 41 in a longitudinal direction.

The capacitor 45 may function as a power source and may be connected to an external power source. Therefore, power may be supplied to the center lead 20 and the side lead 21 through the pair of F-leads.

The cooling fins 38 may be installed or provided between an inner circumferential surface of the yoke 10 and an outer circumferential surface of the anode cylinder 11. The cooling fins 38 may cool the anode.

The antenna cap 35 may be disposed on or at an upper side the A-ceramic 28 and may be covered to protect a junction portion of the exhaust pipe.

Figure 2:
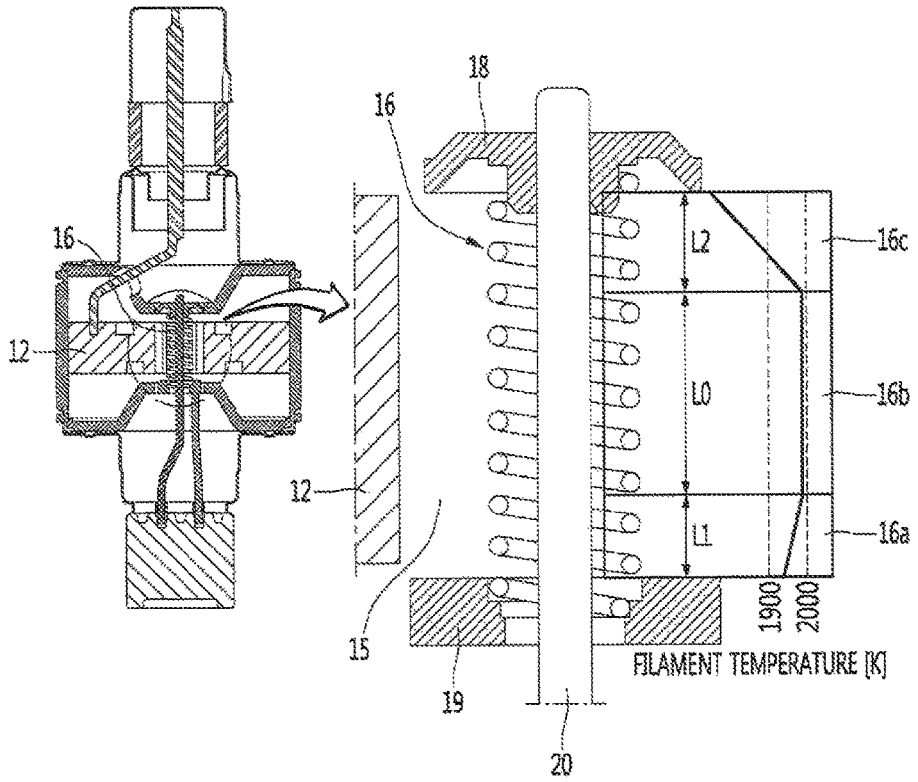
FIG. 2 is an experimental graph illustrating a temperature distribution of a filament.

FIG. 2 is an experimental graph illustrating a temperature distribution of a filament of the magnetron. With reference to FIG. 2, the center lead 20 and the filament 16 may be supported by upper end shield 18 and lower end shield 19. More specifically, the upper end shield 18 may support an upper portion of the filament 16 and the lower end shield 19 may support a lower portion of the filament 16.

The upper portion and lower portion of the filament 16 adjacent to the upper end shield 18 and the lower end shield 19 respectively may be cooled by the upper end shield 18 and the lower end shield 19, which have a relatively low temperature. Therefore, at the upper portion and lower portion of the filament 16, a constant electron emission temperature (2000K) cannot be maintained, and thus, temperature changes may be generated.

As a weight of the lower end shield 19 is larger than a weight of the upper end shield 18, a heat capacity (C=specific heat×mass m) may also be large. Therefore, a temperature change of an adjacent region of the upper end shield 18 may change more sharply than a temperature change of an adjacent region of the lower end shield 19.

The temperature range at which electrons are emitted, that is, the temperature at which electrons are emitted from the filament 16 exceeding the work function, is a range between about 1900K and about 2000K. The electron emission temperature of the lower portion of the filament 16 under the influence of the lower end shield 19 may rise up from about 1900 K to about 2000 K as the filament 16 moves away from the lower end shield 19.

On the other hand, the electron emission temperature above the filament 16 under the influence of the upper end shield 18 can drop sharply from 2000 K to a temperature which is much lower than 1900K, which is the electron emission temperature as the filament 16 approaches to the upper end shield 16.

Related to such features, in order to explain embodiments more dearly, hereinafter, the filament 16 is divided according to the temperature at which electrons are emitted into the working space.

A portion of the filament 16 which affected by the lower end shield 19 and decreases in temperature toward the lower portion of the filament 16 is referred to as "an HV input portion 16*a*", a portion of the filament 16 whose temperature is uniform is referred to "an electron emitting portion 16*b*", and portion thereof whose temperature is decreased toward the upper portion of the filament 16 under the influence of the upper end shield 18 is referred to as "a RF output portion 16*c*".

A temperature of the electron emitting portion 16*b* may be greater than a temperature of the HV input portion 16*a* and the RF output portion 16*c*. A temperature decrease slope of the RF output portion 16*c* may be larger than a temperature decrease slope of the HV input portion 16*a*. When a length of the electron emitting portion 16*b* is referred to as "L0", a length of the HV input portion 16*a* is referred to as "L1", and a length of the RF output portion 16*c* is referred to as "L2", L0 is larger than L1 or L2.

In order to generate electromagnetic flow energy having a fundamental wave frequency of 2.45 GHz, the temperature of the filament 16 is kept constant at about 2000 K, so that the number of electrons emitted from the filament 16 needs to be uniform. However, as the HV input portion 16*a* is a region where the temperature cannot be maintained at about 2000K and is changed and generates unnecessary electrons, and at the same time belongs to the electron emission temperature range (1900K to 2000K), the number of emitted electrons may be large.

As the electrons emitted from the HV input portion 16*a* correspond to unnecessary oscillation components, the electrons may be a main cause of noise. Therefore, if the lower portion of the filament 16, that is, the HV input portion 16*a*, is less affected by the lower end shield 19, the range in which the constant electron emission temperature may be maintained is further increased and the changing range may be further decreased.

In summary, if the electron emission temperature in the filament 16 is constant at about 2000 K, an oscillation component for obtaining a high frequency corresponding to about 2.45 GHz may be obtained. In other words, if the portion of the filament 16 that keeps the electron emission temperature constant can be maximally secured, output may be increased and if the portion of the filament 16 whose electron emission temperature changes is minimized, noise may be decreased. Therefore, the length of the HV input portion 16*a* may be minimized by decreasing a size of the lower end shield 19. When the size of the lower end shield 19 is decreased, the heat exchange capacity with the adjacent filament 16 is decreased, so that a phenomenon of cooling the filament 16 may be decreased.

On the other hand, in a case where a distance between the lower end shield 19 and the vane 12 is small so as to be adjacent to each other to prevent electron deviation in the axial direction, there is a danger that spark may be generated due to a large voltage difference. Accordingly, an outer diameter of the lower end shield 19 may be formed to be spaced apart from the plurality of vanes 12 by a predetermined distance, while preventing the electron deviation in the axial direction in which the center lead 20 is positioned.

The outer diameter of the lower end shield 19 may have a value of about 80 to 89% of a diameter of an inscribed circle formed by the plurality of vanes 12 disposed radially about the center lead 20. The diameter of the inscribed circle formed by the plurality of vanes 12 disposed in a radial direction may be about 8 to 9 mm. It can be understood that the working space 15 is formed between the inscribed circle formed by the plurality of vanes 12 and the filament 16.

The lower end shield of the magnetron of the related art is formed so that only the function of the lower end shield of shielding electrons deviating in the axial direction is focused on and the outer diameter of the lower end shield is maintained only at a minimum distance from the vane. Therefore, there is a problem that the area of the filament (electron emitting portion) where the electron emission temperature is kept constant is relatively decreased. Therefore, in the magnetron of the related art, there is a problem that noise is relatively increased and output and oscillation efficiency are relatively decreased.

In the magnetron for a microwave oven according to embodiments, in a case where the diameter of the inscribed circle formed by the plurality of vanes 12 is about 8 to 9 mm, the outer diameter of the lower end shield 19 may be about 6.4 to 7.9 mm. For example, when the diameter of the inscribed circle formed by the plurality of vanes 12 is about 8.8 mm, the outer diameter of the lower end shield 19 may be about 7 mm. According to this, the output and oscillation efficiency of the magnetron may be improved while preventing electron deviation in the axial direction. Regarding this, description with respect to experiment data (FIG. 10 to FIG. 12) in which output and oscillation efficiency of the magnetron for a microwave oven according to embodiments are improved and noise decreased will be described hereinafter.

The lower end shield 19 may be formed with a hole in the center so that the center lead 20 may be inserted therethrough. Coil-shaped filament 16 for winding up the center lead 20 may be seated on an inner side of the lower end shield 19. For this reason, the inner diameter of the lower end shield 19 may be greatly increased toward the upper side thereof and a maximum value of the inner diameter of the lower end shield 19 may correspond to the outer diameter of the filament 16. For example, when the outer diameter of the filament 16 is about 3.5 mm to 4 mm, the maximum inner diameter of the lower end shield 19 may be about 3.5 mm to 4 mm.

Figure 3:
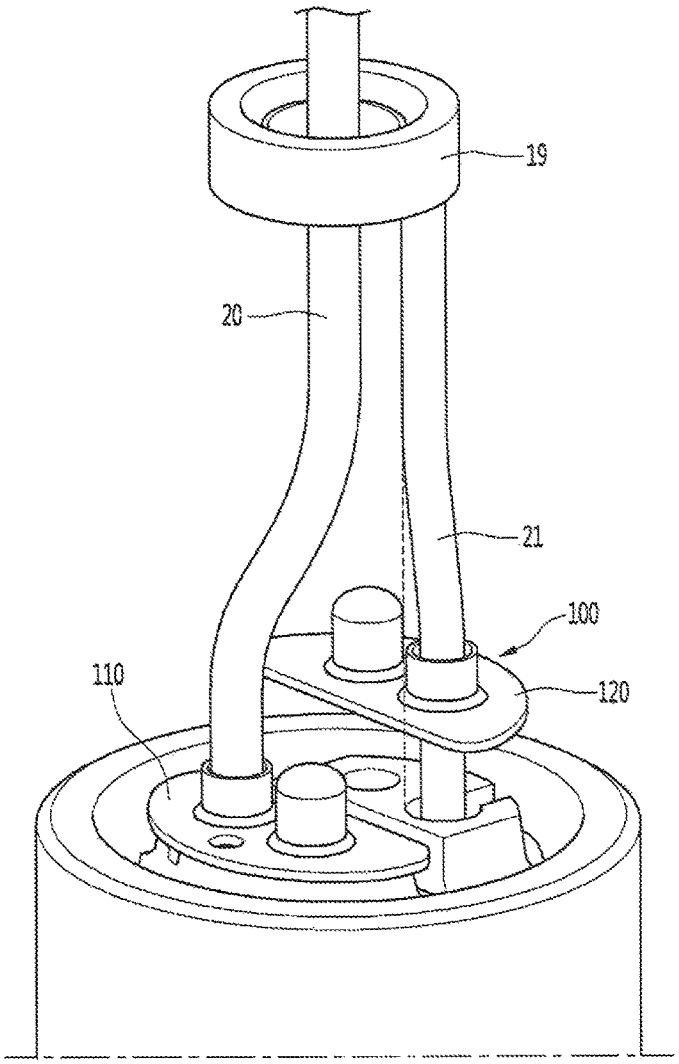
FIG. 3 is a view of a portion of the magnetron of FIG. 1.
Figure 4:
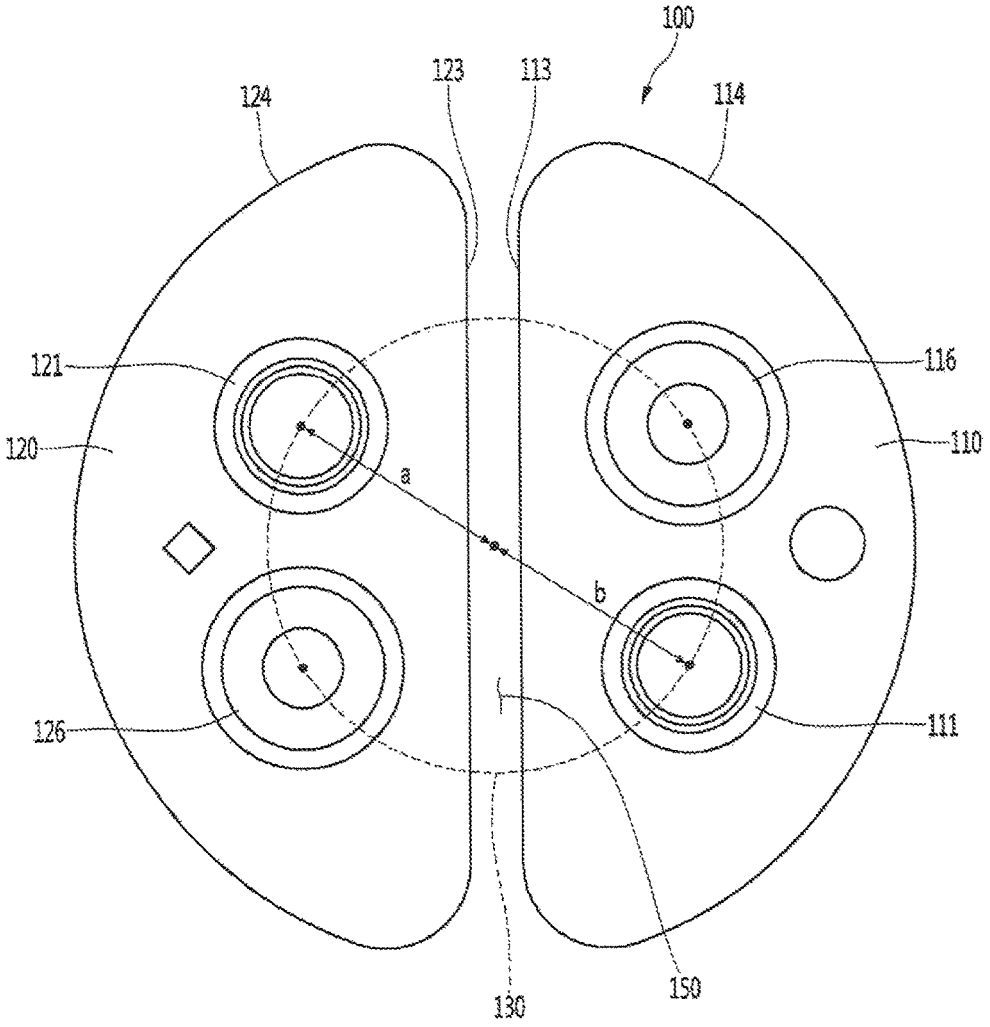
FIG. 4 is a view illustrating a shield disc of the magnetron of FIG. 1.

FIG. 3 is a view of a portion of the magnetron of FIG. 1. FIG. 4 is a view illustrating a shield disc of the magnetron of FIG. 1.

With reference to FIG. 3 and FIG. 4, the shield disc 100 may include side lead disc 120 which is in contact with and connected to the side lead 21 and center lead disc 110 which is in contact with and connected to the center lead 20. The center lead disc 110 may include a center lead hole 111 to which the center lead 20 is connected and a first F-lead hole 116 which is connected to a first F-lead which is one of a pair of F-leads 42.

The center lead disc 110 may be formed in a semicircular shape. The center lead disc 110 may further include a first curved portion 114 forming a half of an outward portion of a periphery of the shield disc 100 with a constant curvature and a first rectilinear portion 113 which has a straight line shape and forms an inward portion of the periphery of the shield disc 100.

The side lead disc 120 may include a side lead hole 121 to which the side lead 21 may be connected and a second F-lead hole 126 which is connected a second F-lead which is the other one of the pair of F-leads 42. The side lead disc 120 may be formed in a semicircular shape.

The side lead disc 120 may further include a second curved portion 124 which forms a remaining half of an outward portion of the periphery of the shield disc 100 with a constant curvature, and a second rectilinear portion 123 which has a straight line shape and forms an inward portion of the periphery of the shield disc 100. The inward portion of the periphery of the shield disc 100 means a portion facing a center portion where a midpoint of the shield disc 100 is positioned, and more specifically, means an edge portion or edge where the center lead disc 120 and the center lead disc 110 are spaced apart from each other and face each other.

The first rectilinear portion 113 and the second rectilinear portion 123 may be spaced apart by a predetermined distance so as to face each other. Therefore, an overall outer appearance of the shield disc 100 may be formed in a circular shape by the first curved portion 114 and the second curved portion 124.

In addition, as the center portion of the shield disc 100 is spaced apart in parallel so that the first rectilinear portion 113 and the second rectilinear portion 123 face each other, a space 150 between two parallel straight lines may be formed. The space 150 may be referred to as "a center space 150 of the shield disc 100".

The center space 150 may be formed in a straight line by two parallel straight lines. In other words, the center lead disc 110 and the side lead disc 120 may be spaced apart from each other on a parallel plane by a predetermined distance and the overall outer appearance of the shield disc 100 may form a circular shape.

As described above, the side lead 21 may be provided on a bottom surface of the lower end shield 19. Therefore, when an outer diameter of the lower end shield 19 is decreased, a position where the side lead 21 is installed on the lower surface of the lower end shield 19 may be changed.

Hereinafter, with reference to FIG. 4, a virtual circle 130 is set as a positional reference for describing an embodiment. The virtual circle 130 means a circle which is configured by points located at distances which are equal to a distance from a midpoint or center of the shield disc 100 to a midpoint or center of the first F-lead hole 116. The midpoint of the shield disc 100 is the same as a midpoint of the virtual circle 130.

The virtual circle 130 may be formed as a curved line which is configured by points which are at a predetermined distance from the midpoint of the shield disc 100. The predetermined distance refers to the distance from the midpoint of the virtual circle 130 to the midpoint of the first F-lead hole 116 and the distance from the midpoint of the virtual circle 130 to the midpoint of the second F-lead hole 126, which are equal to each other.

In addition, with reference to FIG. 4, the distance from the midpoint of the virtual circle 130 to the midpoint of the center lead hole 111 and the distance from the midpoint of the virtual circle 130 to the midpoint of the side lead hole 121 may be constant. In other words, the virtual circle 130 may be formed by connecting the midpoints of the side lead hole 121, the first F-lead hole 116, the center lead hole 111, and the second lead hole 126.

A radius of the virtual circle 130 is equal to the distance from the midpoint of the virtual circle 130 to the midpoint of the plurality of holes 121, 116, 111, and 126. A distance a between the midpoint of the side lead hole 121 and the midpoint of the virtual circle 130 is equal to a distance b between the midpoint of the center lead hole 111 and the midpoint of the virtual circle 130. The distance a and the distance b may be equal to the radius of the virtual circle 130.

The side lead of the related art is connected to the side lead hole formed on an upper surface of the shield disc and can be connected by connecting a straight line from the lower end shield to the side lead hole. However, in the magnetron for a microwave oven according to embodiments, as the size of the lower end shield 19 decreases, the position of the side lead 21 may be changed inwardly of the lower end shield 19, and in this case, the side lead 21 cannot be connected to the upper surface of the shield disc 100 in a straight line (see dotted line in FIG. 3). Accordingly, the side lead 21 can be connected to the shield disc 100 by connecting the side lead 21 to the side lead hole 121 in a bent shape.

Since the side lead 21 is connected to the side lead hole 121 in a bent shape, a bending process is added in the manufacturing process of the side lead 21 unlike the method of the related art. This may cause problems such as an increase in manufacturing cost and an increase in machining time.

Hereinafter, in order to solve the problem caused by the bending process being added to the side lead 21 connected to the shield disc 100 due to the size decrease of the lower end shield 19, various embodiments of the shield disc 100 will be described hereinafter. In the discussion of the following embodiments, repetitive description for configurations overlapping with previous embodiments has been omitted.

Figure 5:
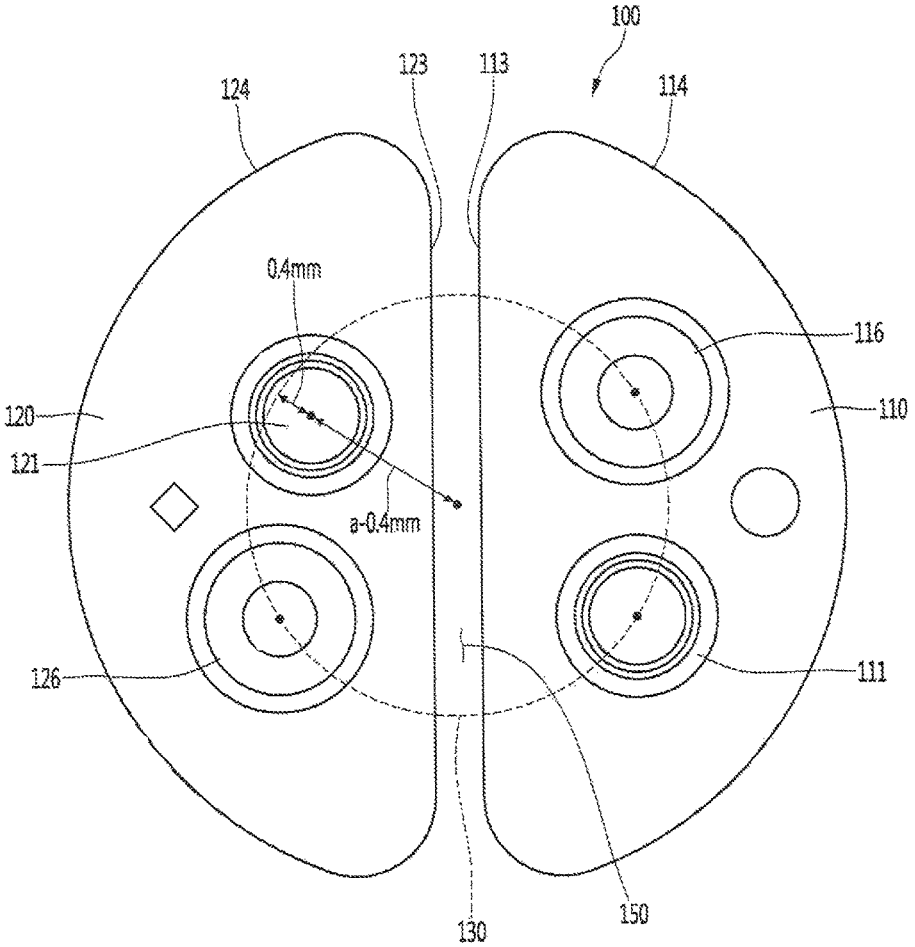
FIG. 5 is a view illustrating a shield disc of a magnetron according to another embodiment.

FIG. 5 is a view illustrating a shield disc of a magnetron according to another embodiment. With reference to FIG. 5, the side lead hole 121 may be formed to approach the midpoint of the virtual circle 130 from the side lead disc 120. The side lead hole 121 may be positioned so as to correspond to a position where the side lead 21 is connected to the lower end shield 19 in a straight line. For example, the side lead hole 121 may be formed at a point where a vertical line drawn from the point to which the side lead 21 is connected to the lower surface of the lower end shield 19 meets the side lead disc 120. In other words, the upper end and lower end of the side lead 21 may be connected to the lower end shield 19 and the side lead hole 121, respectively, in a straight line.

When compared with the previous embodiment, the midpoint of the side lead hole 121 may be formed by moving from any one point of the virtual circle 130 positioned at the side lead disc 120 toward the midpoint of the virtual circle 130 by a corresponding distance to a position at which the lower end shield 19 and the side lead 21 is connected to each other. In this case, the distances a and b may be equal to the radius of the virtual circle 130.

The side lead hole 121 may be formed such that the midpoint of the side lead hole 121 is positioned inside the virtual circle 130. For example, the distance between the midpoint of the side lead hole 121 and the midpoint of the virtual circle 130 may be set to a value obtained by subtracting about 0.4 mm from the distance a. In other words, the midpoint of the side lead hole 121 may be understood as a position which is moved from the radius of the virtual circle 130 toward the midpoint of the virtual circle 130 by about 0.4 mm.

As described above, the formation position of the side lead hole 121 is moved in the side lead disc 120, so that the side lead 21 may be connected to the lower end shield 19 and the side lead disc 120 in a straight line without additional bending process required. However, when the changing width of decrease of the size of the lower end shield 19 is large, the position of the side lead hole 121 connected to the side lead 21 in a straight line may be further relatively moved toward the midpoint of the circle 130. In other words, in the manufacturing process of the side lead disc 120, the formation position of the side lead hole 121 may be too close to the second straight portion 123 corresponding to one end portion of the side lead disc 120.

In a case where the side lead holes 121 and the second rectilinear portions 123 are too close to each other, it is difficult to form the side lead hole 121 and an interval between the side lead hole 121 and the second straight portion 123 is too short and thus cutting, or deformation thereof, for example, may easily occur even at a small pressure. In other words, a defective rate of the side disc 120 may be increased.

In order to decrease the defective rate as described above, the side lead disc 120 may be formed such that the distance between the second straight portion 123 and the side lead hole 121 may be increased by a predetermined length. The side lead disc 120 may be formed such that an interval from the side lead hole 121 to the periphery of the side lead disc 120 is maintained to be equal to or longer than a predetermined length.

Of course, the reason why the defective rate of the side lead disc 120 is increased may be also similarly applied to the center lead disc 110. Therefore, the center lead disc 110 may be formed such that the distance between the first straight portion 113 and the center lead hole 111 is increased by a predetermined length.

On the other hand, the side lead disc 120 may be formed such that the interval between the side lead holes 121 and the second F-lead holes 126 is maintained at a predetermined length or more. In other words, the side lead hole 121 and the second F-lead hole 126 may be positioned to be spaced apart from each other by a predetermined distance.

In the manufacturing process of the side lead disc 120, when an interval between the side lead hole 121 and the second F-lead hole 126 is considerably decreased, formation of the side lead holes 121 which is formed by punching the side lead disc 120 and the second F-lead hole 126, which forms a bent portion by pressing the lower surface of the side lead disc 120, may be very difficult. In other words, a problem that the defective rate increases during manufacture of the side lead disc 120 may result. Similarly, for the reason described above, the center lead disc 110 may be formed to maintain an interval between the center lead hole 111 and the first F-lead hole 116 at a predetermined length or more.

Hereinafter, another embodiment which is capable of solving the problem that the defective rate of the shield disc 100 increases will be described, including a case where the side lead hole 121 is positioned too close to the second rectilinear portion 123, a case where the center lead hole 111 is positioned too close to the first rectilinear portion 113, a case where the side lead hole 121 is positioned too close to the second F-lead hole 126, or a case where the center lead hole 111 is too close to the first F-lead hole 116.

Figure 6:
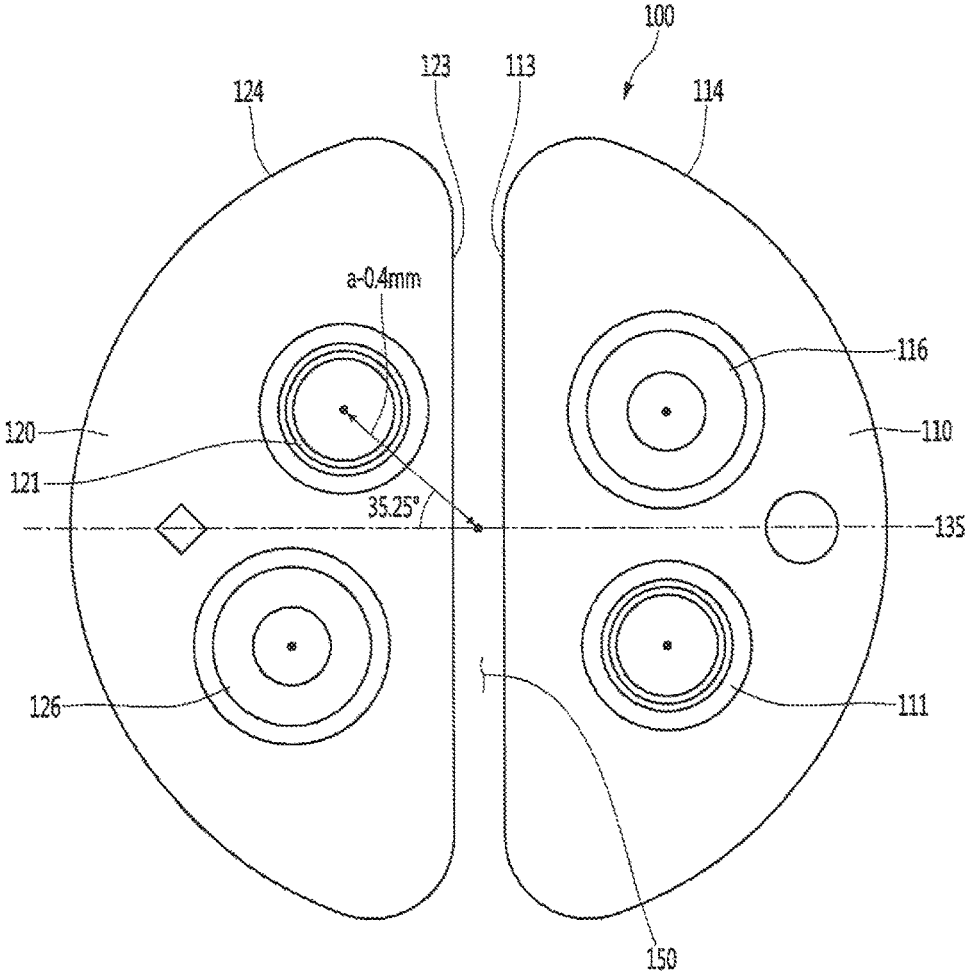
FIG. 6 is a view illustrating a shield disc of a magnetron according to still another embodiment.
Figure 7:
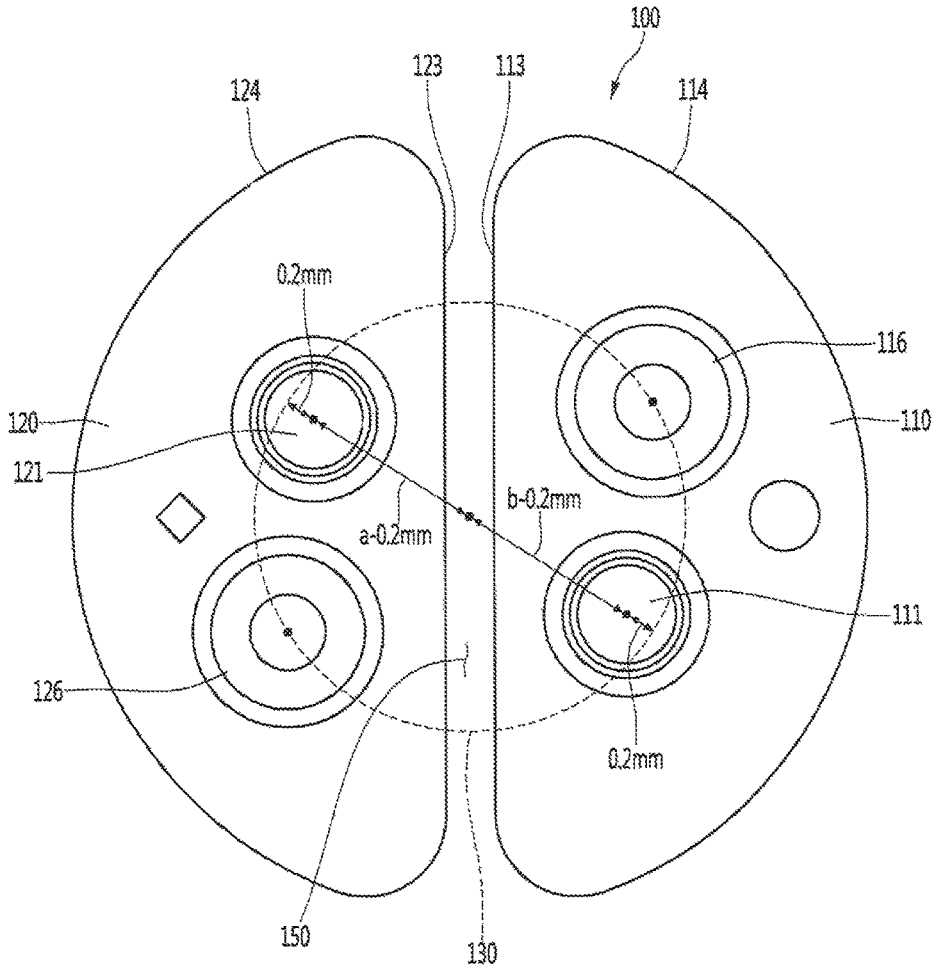
FIG. 7 is a view Illustrating a shield disc of a magnetron according to yet another embodiment.
Figure 8:
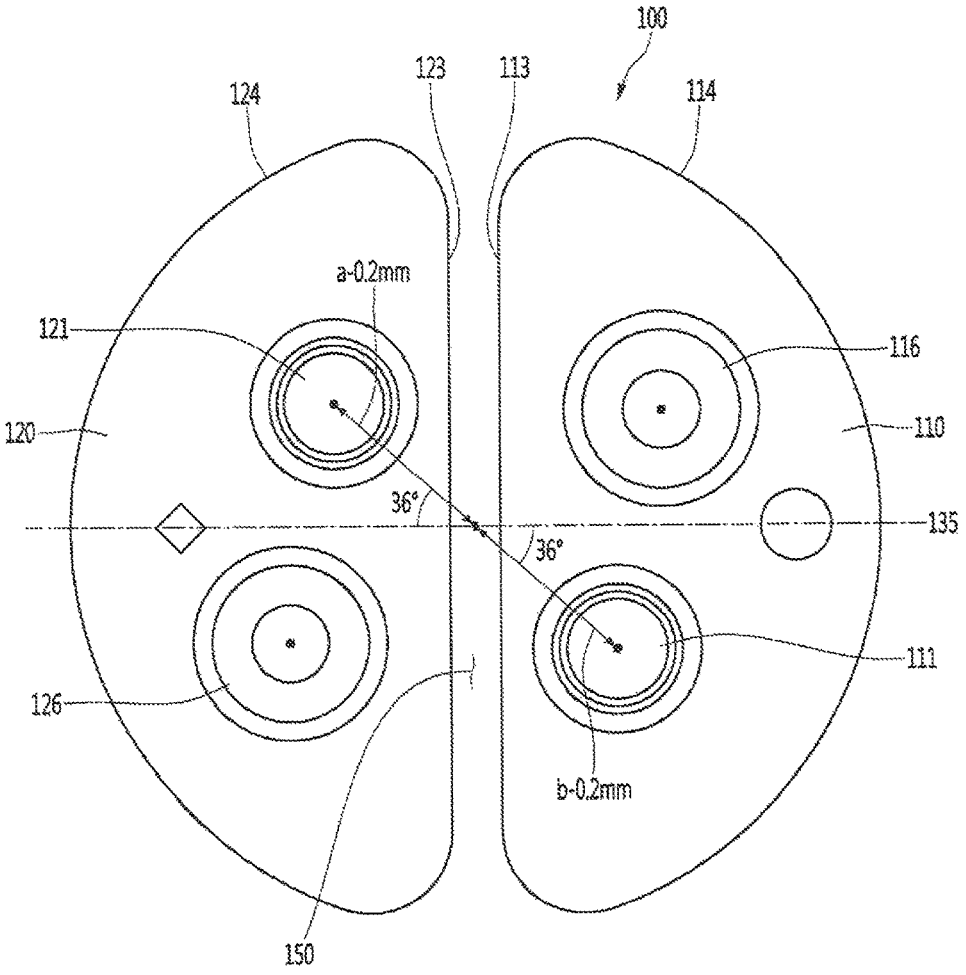
FIG. 8 is a view Illustrating a shield disc of a magnetron according to yet another embodiment.

FIG. 6 is a view illustrating a shield disc of a magnetron according to still another embodiment. FIG. 7 is a view illustrating a shield disc of a magnetron according to yet another embodiment. FIG. 8 is a view illustrating a shield disc of a magnetron according to still another embodiment.

With reference to FIG. 6, the side lead hole 121 may be formed so as to approach the midpoint of the virtual circle 130 in the side lead disc 120 and at the same time, so as to have a predetermined angle with a virtual horizontal line 135 which passes through the midpoint of the shield disc 100. In other words, the side lead holes 121 may be formed so that the midpoint of the side lead holes 121 is positioned inside the virtual circle 130 and has a predetermined angle with respect to the virtual horizontal line 135.

The virtual horizontal line 135 passes through the midpoint of the shield disc 100 and refers to a virtual line bisecting the shield disc 100 into an upper portion and a lower portion. More specifically, the center lead disc 110 is bisected such that an upper portion and a lower portion thereof are symmetrical with respect to the virtual horizontal line 135, and in addition, the side lead disc 120 is bisected so that an upper portion and a lower portion thereof are symmetrical to each other with respect to the virtual horizontal line 135.

The side lead hole 121 of the side lead disc 120 and the first F-lead hole 116 of the center lead disc 110 may be positioned above the virtual horizontal line 135 and the second F-lead hole 126 of the side lead disc 120, and the center lead hole 111 of the center lead disc 110 may be positioned below the virtual horizontal line 135. The midpoint of the side lead hole 121 may be positioned by moving from any one point on the virtual circle 130 positioned on the side lead disc 120 toward the midpoint of the virtual circle 130 by a predetermined length, and at the same time, the midpoint of the side lead hole 121 may be positioned by moving clockwise from a virtual horizontal line 135 passing through the midpoint of the virtual circle 130, that is, the midpoint of the shield disc 10. More specifically, the midpoint of the side lead hole 121 may be positioned to have an angle between 25 degrees and 45 degrees with respect to the virtual horizontal line 135. The distance a may be smaller than the radius of the virtual circle 130. For example, the midpoint of the side lead hole 121 may be positioned at an angle of about 35.25 degrees upward from the virtual horizontal line 135. The midpoint of the side lead hole 121 may be positioned at a point which is rotated clockwise from the virtual horizontal line 135 by about 35.25 degrees in the side lead disc 120. The midpoint of the side lead hole 121 may be positioned to be closer to the second straight line 123 than the virtual horizontal line 135.

A point at which the side lead 21 is connected to the lower surface of the lower end shield 19 corresponding to the side lead hole 121 positioned at the rotated position may be formed. Therefore, the side lead 21 may connect the lower surface of the lower end shield 19 and the side lead hole 121 in a straight line.

Accordingly, the side lead 21 may be connected to the lower end shield 19 and the side lead hole 121 in a straight line even if the size of the lower end shield 19 is decreased, and at the same time, as the position of the side lead hole 121 may be formed so that the minimum separation distance to the second F-lead hole 126 may be maintained, the manufacturing defective rate of the shield disc 100 may be decreased. In addition, the bending process of the side lead 21 is not necessary.

However, in a case where the changing width decreasing the size of the lower end shield 19 is increased, that is, as the outer diameter of the lower end shield 19 is decreased, as the distance spaced apart from the second rectilinear portion 123 is decreased, there is also a restriction to this embodiment.

Hereinafter, another embodiment is also provided in which the distance spaced apart from the second rectilinear portion 123 is maintained to a minimum, and at the same time, the distance spaced apart from the second F-lead hole 126 to a minimum is maintained. Accordingly, there is an advantage that the size of the lower end shield 19 may be further decreased as compared with the previous two embodiments.

With reference to FIG. 7, the side lead hole 121 and the center lead hole 111 may be formed so as to approach the midpoint of the virtual circle 130. The midpoint of the side lead hole 121 and the midpoint of the center lead hole 111 may be positioned inside the virtual circle 130. More specifically, the midpoint of the side lead hole 121 and the midpoint of the center lead hole 111 may be moved toward the midpoint of the virtual circle 130 by a predetermined length. In addition, the midpoint of the side lead hole 121, the midpoint of the virtual circle 130, and the midpoint of the center lead hole 111 may be moved to form a straight line.

For example, the midpoint of the side lead hole 121 and the midpoint of the center lead hole 111 may be positioned by moving toward the midpoint of the virtual circle 130 by about 0.2 mm, respectively. In other words, the midpoint of the side lead hole 121 at the midpoint of the virtual circle 130 may be positioned at a distance which is subtracted from the distance a by about 0.2 mm. In addition, the midpoint of the center lead hole 111 at the midpoint of the virtual circle 130 may be positioned at a distance which is subtracted from the distance b by about 0.2 mm. The distances a and b are equal to the radius of the virtual circle 130.

On the other hand, the center lead 20 may include a bending portion in a bent shape. The center lead 20 may be connected to the center lead hole 111 of the center lead disc 110 through the midpoint of the lower end shield 19. Therefore, the center of the lower end shield 19 and the center of the shield disc 100 may be positioned on the same straight line, and in addition, may be positioned symmetrically with each other. Accordingly, the center lead 20 may be connected in a bent shape when connected to the center lead hole 111 as in the related art.

The center lead 20 may include a bending process in manufacturing process thereof as in the prior art. The center lead 20 may be formed so as to correspond to a change in the position of the center lead hole 111 in the bending process.

As the bending degree can be adjusted in accordance with the position change of the center lead hole 111 when the center lead 20 is manufactured, a new process is not added or necessary. Therefore, problems such as an Increase in cost and an increase in the process time for manufacturing the center lead 20 are not generated. As a result, there is an advantage that the decrease restriction of the size of the lower end shield 19 may be relatively further increased through movement of the center lead hole 111.

With reference to FIG. 8, a difference from the previous embodiment is that the center lead hole 111 and the side lead hole 121 may be formed considering a distance spaced apart the center lead hole 111 and the first F-lead hole 116 from each other and a distance spaced apart the side lead hole 121 and the second F-lead hole 126 from each other. As in the previous embodiment, the center lead hole 111 and the side lead hole 121 may be formed so as to approach the midpoint of the virtual circle 130. In other words, the midpoint of the side lead hole 121 and the midpoint of the center lead hole 111 may be positioned inside the virtual circle 130. At the same time, the center lead hole 111 and the side lead hole 121 may be formed at a predetermined angle with the virtual horizontal line 135. More specifically, the midpoints of the center lead hole 111 and the side lead hole 121 may be positioned to have an angle between about 25 degrees and about 45 degrees about the virtual horizontal line 135. For example, a straight line connecting the midpoint of the center lead hole 111 and the midpoint of the side lead hole 121 to the midpoint of the virtual circle 130 may be about 36 degrees about the virtual horizontal line 135. The midpoints of the center lead holes 111 and the side lead holes 121 may be positioned closer to the first rectilinear portion 113 and the second rectilinear portion 123 than the virtual horizontal line 135.

Accordingly, in a case where the connection points between the shield disc 100 and the side lead 21 and between the shield disc 100 and the center lead 20 due to the decrease of the size of the lower end shield 19 are changed, the center lead hole 111 and the first F-lead hole 116 may be maintained at a predetermined interval from each other and the side lead hole 121 and the second F-lead hole 126 may be maintained at a predetermined interval from each other, and thus, the defective rate of the shield disc 100 may be decreased.

In addition, the previous embodiment and this embodiment may further decrease the size of the lower end shield 19 than that of the two previous embodiments. In other words, the changing width regarding to decrease in the size of the lower end shield 19 may be increased. Therefore, there is an advantage that oscillation efficiency and output of the magnetron may be further relatively improved and noise may be further relatively decreased.

Figure 9:
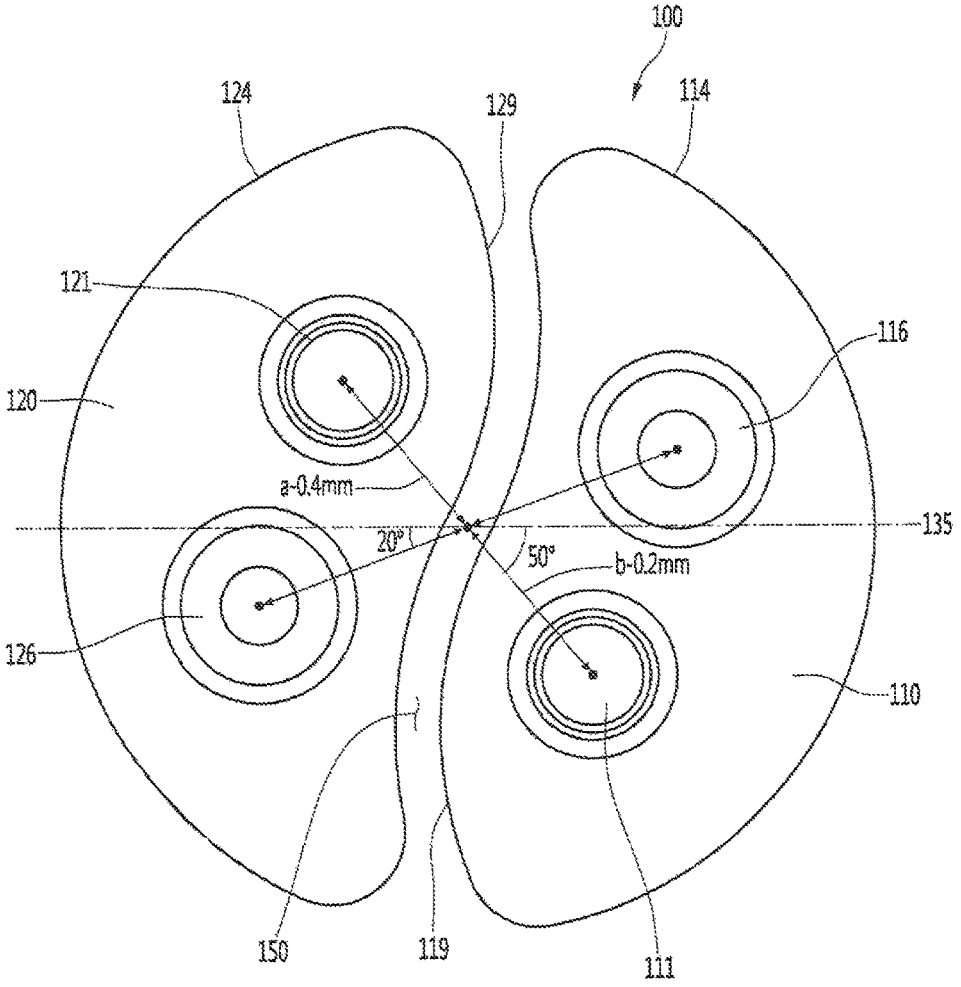
FIG. 9 is a view illustrating a shield disc of a magnetron according to yet another embodiment.

FIG. 9 is a view illustrating a shield disc of a magnetron according to yet another embodiment. This embodiment will be described with reference to FIG. 9. This embodiment may solve the restriction on the formation positions of the side lead hole 121 and the center lead hole 111 as described above, and thus, an optimized shield disc 100 is proposed which may also decrease a size of a lower end shield 19 to be maximized as far as possible.

This embodiment differs from the previous embodiment in that space 150 formed at the center portion of the shield disc 100 forms a wavy shape in which a recessed portion and a protruding portion are formed. In this embodiment, repetitive description overlapping with the previous embodiment has been omitted.

With reference to FIG. 9, the center lead disc 110 may further include a first wavy portion 119 forming an edge portion of the periphery thereof and having a wavy shape. It can be understood that the first wavy portion 119 is formed so that the first straight portion 113 described in the previous embodiment has a wavy curve instead of a straight line. The side lead disc 120 may further include a second wavy portion 129 which forms an edge portion of the periphery thereof and is formed in a shape corresponding to the first wavy portion 119. It can be understood that the second wavy portion 129 is formed so that the second straight portion 123 described in the previous embodiment has a wavy curve instead of a straight line.

The first wavy portion 119 and the second wavy portion 129 may form an inward portion of the periphery of the shield disc 100. As the center lead disc 110 and the side lead disc 120 are spaced apart from each other to form a space therebetween, the center portion of the shield disc 100 may not be a straight space but a curved wavy space 150. In other words, a wavy space may be formed at the center portion of the shield disc 100. More specifically, the space 150 formed at the center of the shield disc 100 may be formed to have a recessed and protruding wavy shape about the midpoint of the shield disc 100. In addition, the space 150 formed by the first wavy portion 119 and the second wavy portion 129 may be point symmetry about the midpoint of the shield disc 100.

The first wavy portion 119 may include a first recessed portion or recess which is recessed inwardly of the center lead disc 110 and a first protruding portion or protrusion which protrudes outward from the center lead disc 110 in the opposite direction thereto. The first recessed portion and the first protruding portion may be divided into the upper portion and the lower portion about the virtual horizontal line 135.

The second wavy portion 129 may include a second recessed portion or recess which is recessed inward of the side lead disc 120 and a second protruding portion or protrusion that protrudes outward of the side lead disc 120 in the opposite direction thereto. The second recessed portion and the second protruding portion may be divided into the upper portion and the lower portion about the virtual horizontal line 135.

The recessed portion (recess portion) of the first wavy portion 119 may be disposed so as to correspondingly face the protruding portion of the second wavy portion. In addition, the protruding portion of the first wavy portion 119 may be correspondingly disposed to face the recessed portion of the second wavy portion. In other words, the first recessed portion may be disposed to face the second protruding portion and the first protruding portion may be disposed to face the second recessed portion.

As the first wavy portion 119 and the second wavy portion 129 are correspondingly disposed to face each other so as to face each other at a predetermined distance, the overall outer appearance of the shield disc 100 may have a taegeuk shape.

The first recessed portion may be formed to correspond to a position where the first F-lead hole 116 is formed and the first protruding portion may be formed to correspond to a position where the center lead hole 111 is formed. The second recessed portion may be formed to correspond to a position where the second F-lead hole 126 is formed and the second protruding portion may be formed to correspond to a position where the side lead hole 121 is formed.

One portion (first protruding portion) of the first wavy portion 119 positioned close to the center lead hole 111 has a protruding shape so as to maintain a distance spaced apart from the center lead hole 110 and a portion of (second recessed portion) of the second wavy portion 129 positioned close to the corresponding second F-lead hole 126 can be formed to be recessed. Similarly, another portion (second protruding portion) of the second wavy portion 129 formed in the vicinity of the side lead hole 121 may be convexly formed so as to maintain a distance spaced apart from the side lead hole 121, and the other portion (first recessed portion) of the first wavy portion 119 formed in the vicinity of the first F-lead hole 116 may be recessed.

By the first wavy portion 119 and the second wavy portion 129, the center lead hole 111 and the side lead hole 121 are positioned to have a larger angle about the virtual horizontal line 135 than in the previous embodiment and may be positioned as close as possible to the midpoint of the shield disc 100 inside the virtual circle 130. The minimum interval at which the side lead hole 121 is spaced apart from the second-F lead hole 126 and the second wavy portion 129 is set to be the same in all embodiments. Therefore, the position of the side lead hole 121 having the minimum gap may have a relatively larger angle from the virtual horizontal line 135 and may be positioned closer to the midpoint of the virtual circle 130 by the second wavy portion 129, which is convexly formed to correspond to the side lead hole 121.

Similarly, the minimum interval at which the center lead hole 111 is spaced apart from the first-F lead hole 116 and the first wavy portion 119 is set to be the same in all embodiments. Accordingly, the position of the center lead hole 111 having a minimum interval may have a relatively larger angle from the virtual horizontal line 135 and may be positioned closer to the midpoint of the virtual circle 130, by the first wavy portion 119, which is convexly formed to correspond to the center lead hole 111. For example, in the previous embodiment, when the distance that the side lead hole 121 and the center lead hole 111 can move together to the maximum is about 0.4 mm, in this embodiment, the side lead hole 121 may be positioned at a position which is subtracted by about 0.4 mm from the radius a of the midpoint of the shield disc 100 and the side lead hole 121 may be positioned at a distance which is subtracted by about 0.2 mm from the radius b while meeting all restrictions on the separation distance of the side lead hole 121 and the center lead hole 111.

The midpoint of the center lead hole 111 and the midpoint of the side lead hole 121 may be positioned at the positions forming an angle of about 25° to about 75° about the virtual horizontal line 135. For example, in the previous embodiment, when an angle that the midpoints of the side lead hole 121 and the midpoints of center lead hole 111 may be rotated to the maximum degree and positioned at about 45 degrees (in a case of being maintained to a minimum distance which is spaced apart from each rectilinear portion), in this embodiment, the midpoints of the side lead hole 121 and the center lead hole 111 may be positioned at about 50 degrees from the virtual horizontal line 135 while meeting all restrictions on the separation distance of the side lead hole 121 and the center lead hole 111 from a pair of F-leads 116 and 126. At this time, the changing width for decrease of size of the lower end shield 19 may be increased by the midpoints of a pair of F-leads 116 and 126 being positioned to form about 20 degrees from the virtual horizontal line 135 in a direction opposite to the midpoints of the side lead hole 121 and the center lead hole 111, and thus, forming a smaller angle than in the related art.

According to the shield disc 100 which has the overall outer appearance of the Taeguek shape, as the side lead hole 121, all the center lead hole 111 and the pair of F-leads 116 and 126 are moved and/or rotated, and thus, the shield disc 100 may be manufactured, the optimized shield disc 100 according to the decrease of the lower end shield 19 may be formed. In other words, compared with the other embodiments described above, as the size of the lower end shield 19 may be further decreased, the output and the oscillation efficiency of the magnetron may be improved and the noise may be decreased.

Figure 11A:
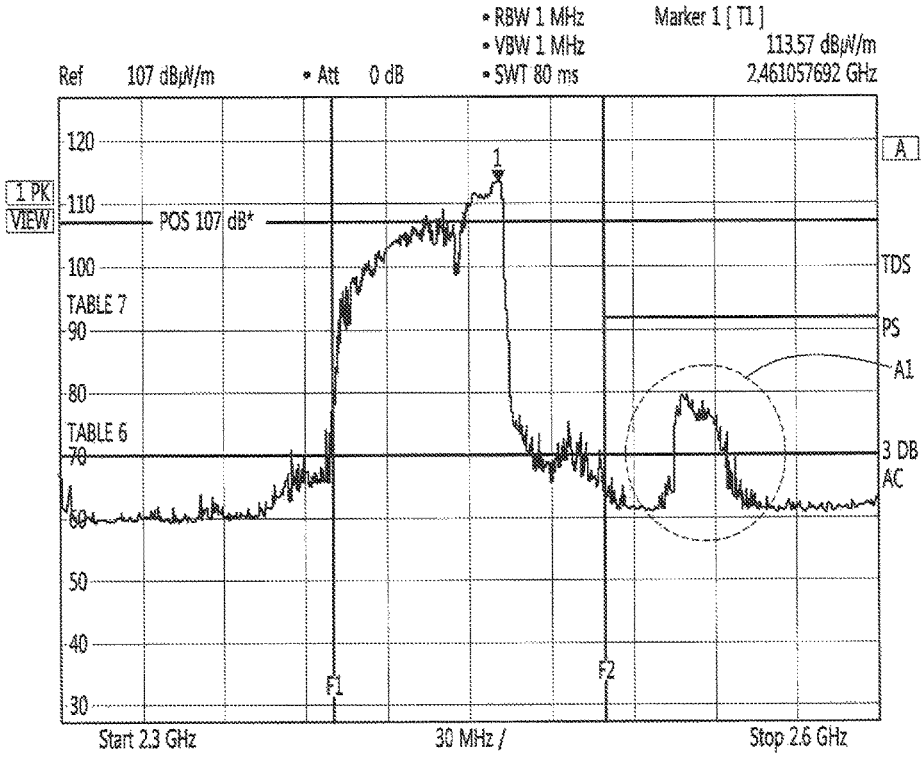
FIG. 11A and FIG. 11B are experimental graphs illustrating a state where noise is improved in the fundamental frequency band of the magnetron according to embodiments, compared with the related art.
Figure 11B:
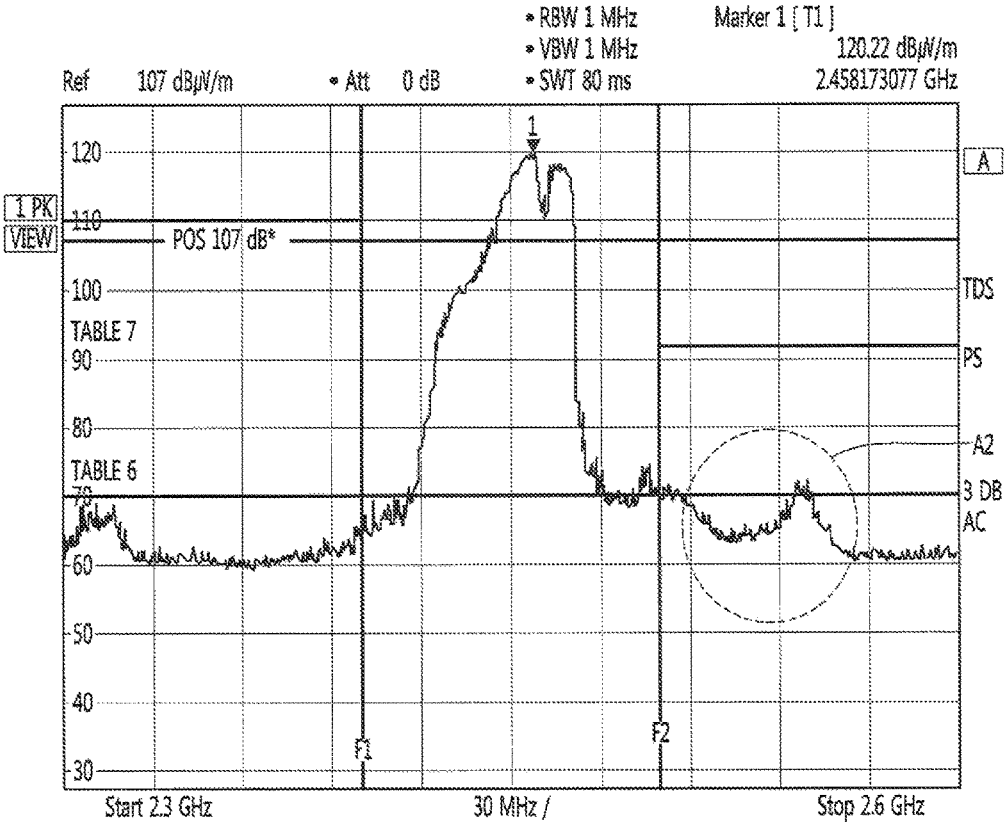
Figure 12A:
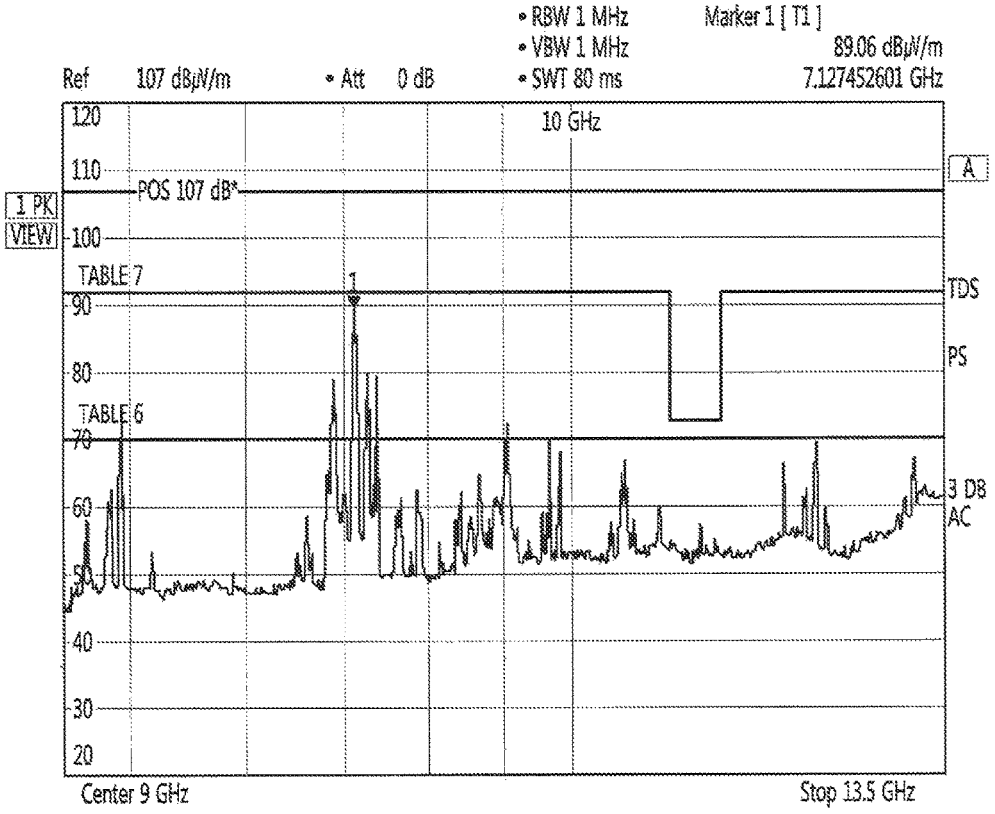
FIG. 12A and FIG. 12B are experimental graphs illustrating a state where noise is improved in the high-frequency band of the magnetron according to embodiments, compared with the related art.
Figure 12B:
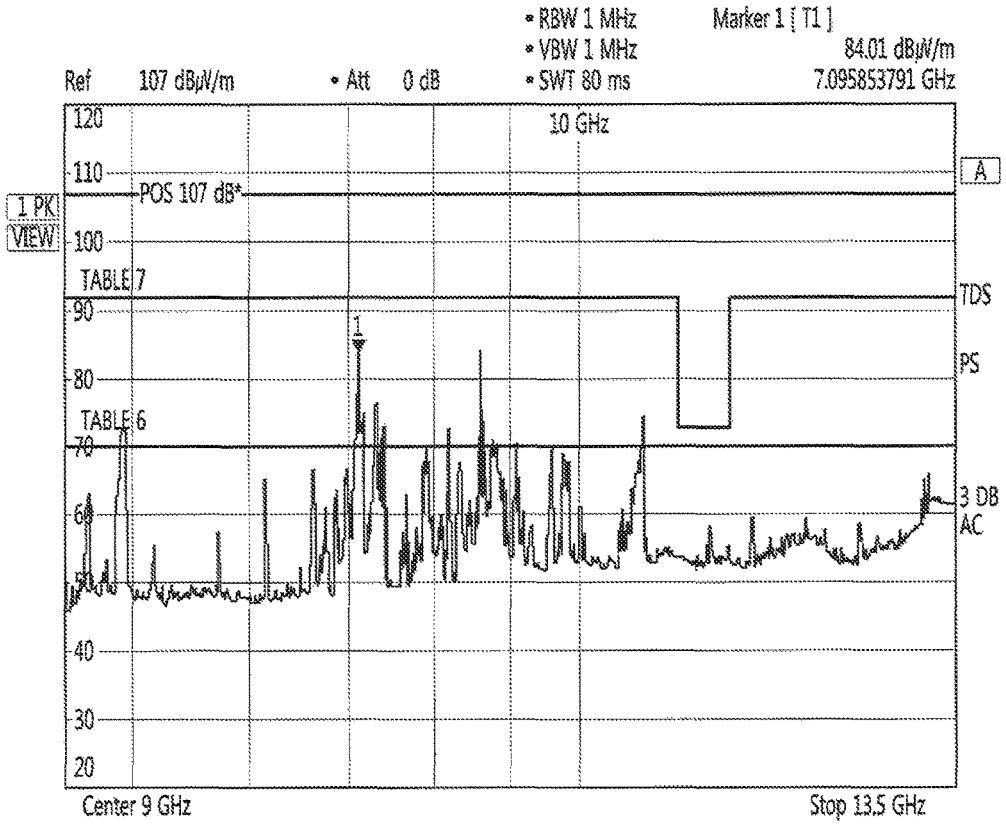

FIG. 10 is a graph illustrating an experimental result table illustrating a state where output and efficiency of a magnetron according to embodiments are improved, compared with the related art. FIG. 11A and FIG. 11B are experimental graphs illustrating a state where noise is improved in the fundamental frequency band of the magnetron according to embodiments, compared with the related art. FIG. 12A and FIG. 12B are experimental graphs illustrating a state where noise is improved in the high frequency band of the magnetron according to embodiments, compared with the related art.

With reference to FIG. 10, MG#1 to MG#10 in the item column are magnetrons (MGT) according to embodiments in which the outer diameter of the lower end shield is decreased to 7 mm. G1#1 to G1#5 therein are magnetrons in the related art and the outer diameter of the lower end shield is 8 mm.

With reference to the experimental result measuring an output Po, an efficiency η, of the MG#1 to MG#10, the average value of the output Po is 1070.6 W and the average value of the efficiency η is 74.4%. These values are improved values than the average output value of 1013 W and the average efficiency η value of 70.7% of the magnetrons G1#1 to G1# of the related art. Accordingly, it can be confirmed that the magnetron according to embodiments has improved output and oscillation efficiency.

If the deviation of the thermal electrons is not prevented in the axial direction of the center lead 20, the output and the oscillation efficiency of the magnetron is unlikely to be improved as the thermal electrons cannot be induced in the vane 12. Therefore, the embodiments have an advantage of preventing deviation of thermal electrons in the axial direction, and at the same time, improving output and oscillation efficiency of the magnetron.

With reference to FIGS. 11A-11B and FIGS. 12A-12B, FIG. 11A and FIG. 12A are experimental graphs measuring output levels dB to the frequency which is generated at the time of oscillation of the magnetron of the related art and FIG. 11B and FIG. 12B are experimental graphs measuring output levels dB to the frequency which is generated at the time of oscillation of the magnetron according to embodiments. The longitudinal axis thereof represents the frequency GHz and the transverse axis thereof represents the output level dB.

With reference to FIG. 11A and FIG. 11B, in a case of the magnetron of the related art, the magnetron of the related art does not have a sharp-shaped output value about 2.45 GHz in the ISM band (2.4 GHz to 2.5 GHz). Specifically, the peak value of the output does not appear near 2.45 GHz and the output at 2.45 GHz does not also reach 120 dB. In addition, as the output level (dB) in the region except for 2.45 GHz is maintained at a high value, unnecessary output, that is, noise having a large output value can cause EMI. As it has a low value of about 4 dB to 5 dB at the electromagnetic interference (EMI) prevention standard of 92 dB μV/m in the region of 2.5 GHz or more (A1), there is a risk of exceeding the allowable standard (92 dB) in a case where the unexpected situation occurs during operation of the magnetron.

On the other hand, the magnetron according to embodiments has an output peak value near 2.45 GHz and the value is also about 120 dB, and thus the reliability further improved than the magnetron operation in the related art. In addition, a sharp-shaped output graph can be obtained and in the ISM band (2.4 GHz to 2.5 GHz) other than 2.45 GHz, an output value which is significantly lower than the magnetron output value of the related art may be obtained.

In other words, the magnetron according to embodiments may decrease the possibility of EMI generation as the fundamental frequency band is decreased and sideband noise is decreased. Therefore, reliability with respect to the operating frequency of the microwave oven has also been improved. In addition, as the peak value is about 10 dB lower than 92 dB in the region of 2.5 GHz or more (A2), the electromagnetic wave interference prevention tolerance standard as compared with the operation of the magnetron of the related art may be stably met and stability and reliability for driving the magnetron may be improved.

In addition, with reference to FIG. 12A and FIG. 12B, it can be confirmed that a stable spectrum is formed even in a harmonic region. In other words, according to embodiments, as noise in the ISM band may be decreased to minimize EMI generation, normal operation of peripheral appliances may be guaranteed, and thus, convenience for the user may be improved.

By the size of the lower end shield being smaller than that of the related art, as the electron beam emitted from the filament during the oscillation is efficiently guided to the vane, the oscillation efficiency and output of the magnetron is improved, and thus, performance of the microwave oven may be improved. Further, as the output (dB) value may stably pass the standard in the frequency range of about 2.5 GHz to about 2.6 GHz, operational reliability of the microwave oven may be improved. Furthermore, there is an effect of decreasing manufacturing costs and decreasing process time as the further bending process of the side lead is not generated due to a change in the shield disc. Therefore, there is an advantage that mass production is facilitated. In addition, the defective manufacturing rate may be decreased through the optimized shape of the shield disc and reliability of the product may be improved.

Embodiments disclosed herein provide a magnetron for a microwave oven which can minimize a problem of EMI generation in the ISM band. Embodiments disclosed herein also provide a magnetron for a microwave oven which may prevent loss of an electron beam emitted when the magnetron oscillates.

Embodiments disclosed herein further provide a magnetron for a microwave oven which can minimize the influence of a lower end shield on the filament and can maximize a portion which maintains a constant electron emission temperature. Embodiments disclosed herein also provide a magnetron for a microwave oven which can solve the problem of increase in cost and time generated by an additional processing in accordance with the size change of the lower end shield. Embodiments disclosed herein provide a magnetron for a microwave oven which can solve the problem that a defective rate in a shield disc process is increased by changing a position and an angle of holes existing in a shield disc.

In the magnetron for a microwave oven according to embodiments, by decreasing the size of the lower end shield, noise in the ISM band may be decreased to minimize EMI generation. Further, in the magnetron for a microwave oven according to embodiments, by setting an outer diameter of the lower end shield to about 6.4 mm to about 7.9 mm, the output value (dB) which may stably pass the electromagnetic interference prevention standard in the frequency range of about 2.5 GHz to about 2.6 GHz may be obtained. In addition, output and oscillation efficiency of the magnetron may be improved therethrough.

Furthermore, in the magnetron for the microwave oven according to embodiments, the outer diameter of the lower end shield may be set to be about 80% to about 89% of the diameter of an inscribed circle which is formed by a plurality of vanes disposed radially, in order to decrease the size of the lower end shield, so that efficient transmission of the electron beam emitted at the time of oscillation may be achieved. Also, in the magnetron for the microwave oven according to embodiments, a midpoint of a side lead hole may be positioned inside a virtual circle formed by points positioned at a predetermined distance from a midpoint of a shield disc, so that the side lead can be connected in a straight line. This has the advantage that an additional bending process of the side lead is not required.

In the magnetron for the microwave oven according to embodiments, as the central portion of the shield disc has a first wavy portion and a second wavy portion so as to have a wavy space, the defective rate that occurs in the manufacturing process of the shield disc may be decreased.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A magnetron for a microwave oven, comprising:

a yoke forming a body of the magnetron;

an anode cylinder installed inside of the yoke;

a plurality of vanes that radially extends toward an axial center of the anode cylinder;

a filament positioned at the axial center of the anode cylinder;

a lower end shield positioned at a lower end of the filament, wherein an outer diameter of the lower end shield is about 80% to about 89% of a diameter of an inscribed circle formed by the plurality of vanes;

a center lead positioned at a center of the filament, wherein a lower end of the center lead extends downward through a center portion of the lower end shield; and a side lead having an upper end which is connected to the lower end shield and spaced apart from the center lead.

2. The magnetron according to claim 1, wherein the outer diameter of the lower end shield is about 6.4 mm to about 7.9 mm.

3. The magnetron according to claim 1, wherein the diameter of the inscribed circle formed by the plurality of vanes is about 8.0 mm to about 9 mm.

4. The magnetron according to claim 1, further comprising:

a center lead disc including a center lead hole connected to the lower end of the center lead and a first filter box lead hole connected to any one of a pair of filter box leads; and a side lead disc including a side lead hole connected to a lower end of the side lead and a second filter box lead hole connected to the other one of the pair of filter box leads.

5. The magnetron according to claim 4, wherein a position of the side lead hole corresponds to a position at which the side lead is connected to the lower end shield in a straight line.

6. The magnetron according to claim 4, wherein the side lead connects the lower end shield and the side lead hole to each other in a straight line.

7. The magnetron according to claim 6, wherein a midpoint of the side lead hole is positioned inside a virtual circle formed by points which are positioned at a same distance as a distance from a midpoint of the shield disc to a midpoint of the first filter box lead hole.

8. The magnetron according to claim 7, wherein the midpoint of the side lead hole is positioned at an angle between about 25 degrees and about 45 degrees from a virtual horizontal line that passes through the midpoint of the shield disc and bisects the side lead disc so as to be symmetrical.

9. The magnetron according to claim 8, wherein a midpoint of the center lead hole is positioned inside the virtual circle.

10. The magnetron according to claim 9, wherein the virtual horizontal line bisects the center lead disc so as to be symmetrical and the midpoint of the center lead hole is positioned at an angle between about 25 degrees and about 45 degrees from the virtual horizontal line.

11. The magnetron according to claim 1, further comprising:

a pair of filter box leads including a first filter box lead and a second filter box lead connected to an external power source; and a pair of shield discs including a center lead disc connected to the center lead and a side lead disc connected to the side lead, wherein the pair of shield discs includes a curved inwardly portion forming a center space that separates the center lead disc and the side lead disc from each other, and wherein the center space has a wave shape.

12. The magnetron according to claim 11, wherein the center lead disc includes a first wavy portion forming an inward portion of a periphery of the shield disc, a center lead hole to which the center lead is connected, and a first filter box lead hole to which the first filter box lead is connected, and wherein the side lead disc includes a second wavy portion forming an inward portion of a periphery of the shield disc, a side lead hole to which the side lead is connected, and a second filter box lead hole to which the second filter box lead is connected.

13. The magnetron according to claim 12, wherein the first wavy portion includes:

a first recess recessed toward an inside of the center lead disc; and a first protrusion that protrudes toward the side lead disc.

14. The magnetron according to claim 13, wherein the second wavy portion includes:

a second recess recessed toward an inside of the side lead disc; and a second protrusion that protrudes toward the center lead disc.

15. The magnetron according to claim 14, wherein the first recess is spaced apart from the second protrusion and the first protrusion is be spaced apart from the second recess.

16. The magnetron according to claim 14, wherein the center lead hole is positioned to correspond to the first protrusion, and wherein the side lead hole is positioned to correspond to the second protrusion.

17. The magnetron according to claim 14, wherein a midpoint of the side lead hole and a midpoint of the center lead hole are positioned at an angle between about 25 degrees and about 75 degrees about a virtual horizontal line that passes through a center of the shield disc.

18. A magnetron for a microwave oven, comprising:

a yoke;

a cathode including a filament disposed inside of the yoke, the filament emitting thermal electrons when power is applied thereto, and a center lead and a side lead which apply the power to the filament;

an anode including an anode cylinder disposed inside of the yoke and a plurality of vanes disposed radially about an axial center of the anode cylinder;

a pair of filter box leads including a first filter box lead and a second filter box lead connected to an external power source; and a pair of shield discs including a center lead disc connected to the center lead and a side lead disc connected to the side lead, wherein the center lead disc includes a center lead hole connected to a lower end of the center lead and a first filter box lead hole connected to the first filter box lead of the pair of filter box leads wherein the side lead disc includes a side lead hole connected to a lower end of the side lead and a second filter box lead hole connected to the second filter box lead of the pair of filter box leads, wherein the pair of shield discs has a curved inwardly portion forming a center space that separates the center lead disc and the side lead disc from each other, and wherein the center space has a wavy shape that allows selective positioning of the center lead hole, the side lead hole, the first filter box lead hole, and the second filter box lead hole.

19. The magnetron according to claim 18, further comprising a lower end shield positioned at a lower end of the filament, wherein an outer diameter of the lower end shield is about 80% to about 89% of a diameter of an inscribed circle formed by the plurality of vanes.

20. The magnetron according to claim 19, wherein a position of the side lead hole corresponds to a position at which the side lead is connected to the lower end shield in a straight line.

* * * * *